US005335730A

United States Patent [19]

Cotham, III

[11] Patent Number: 5,335,730

[45] Date of Patent: Aug. 9, 1994

[54] METHOD FOR WELLHEAD CONTROL

[76] Inventor: Heman C. Cotham, III, P.O. Box 899, Zamil Compound, Khobar, Saudi Arabia

[21] Appl. No.: 14,798

[22] Filed: Feb. 8, 1993

Related U.S. Application Data

[63] Continuation-in-part of Ser. No. 753,744, Sep. 3, 1991, abandoned.

[51] Int. Cl.[5] ..... E21B 34/10

[52] U.S. Cl. ..... 166/374; 166/386; 166/53; 166/75.1

[58] Field of Search ..... 166/50, 53, 250, 369, 166/373, 374; 175/5

[56] References Cited

U.S. PATENT DOCUMENTS

| | | | |
|---|---|---|---|
| 4,285,401 | 8/1981 | Erickson | 166/369 |
| 4,442,902 | 4/1984 | Doremus et al. | 166/374 |
| 4,583,916 | 4/1986 | Senghaas et al. | 166/53 X |
| 4,615,390 | 10/1986 | Lucas et al. | 166/250 |
| 4,616,700 | 10/1986 | Wood et al. | 166/250 |
| 4,633,954 | 1/1987 | Dixon et al. | 166/53 |
| 4,721,158 | 1/1988 | Merritt, Jr. et al. | 166/250 |
| 4,767,280 | 8/1988 | Markuson et al. | 166/250 X |
| 4,896,722 | 1/1990 | Upchurch | 166/250 |
| 5,146,991 | 9/1992 | Rogers, Jr. | 166/369 |

OTHER PUBLICATIONS

"SCI System [SCIS]" Specialty Concepts, Inc., 1988.

"M55 High Efficiency Solar Electric Module," Siemens.

"Dynasty," Johnson Controls.

"ACS Actuator Control Systems," Actuator Control Systems, Ltd.

"FlexiGuard Safety Control System," Amot Controls, 1989.

"The Scanner Analog Data Acquisition & Alarm System," Amot Controls, 1989.

"Log Interpretation, Principles/Applications," Schlumberger Education Series, 1987.

"Production and Transport of Oil and Gas," Szilas, Elsevier Scientific Pub. Co., 1975.

*Primary Examiner*—Ramon S. Britts
*Assistant Examiner*—Frank S. Tsay
*Attorney, Agent, or Firm*—Guy McClung

[57] ABSTRACT

A method is disclosed which, in one aspect, includes providing power to a system for controlling a wellhead from a self-contained stand-alone power source, controlling the delivery of power to the system with a control unit (in one aspect a microprocessor control unit), using various valves to control flow of fluids from within the well and from the well in one or more flowlines, and monitoring various parameters both in the flowlines and in and around the well and the wellhead, including but not limited to fluid pressures and emergency conditions, and shutting-in the well in response to certain signals generated by the system based on the monitoring.

16 Claims, 5 Drawing Sheets

CAUSE/EFFECT CHART FOR SOLAR-BATTERY POWERED WELL CONTROL PANEL

| | EFFECT | | | | |
|---|---|---|---|---|---|
| CAUSE | CLOSE DHV | CLOSE MSSV | CLOSE WSSV | ALARM | STATUS * |
| 220 FLOWLINE PSLL | X | X | X | X | |
| 220 FLOWLINE PSHH | | X | X | X | |
| R2 PSL HYDRAULIC | X | X | X | X | |
| 222 LAL TANK | | | | X | |
| C LSLL TANK | X | X | X | X | |
| 266 LOW BATT VDC | | | | X | |
| 212 FIRE | X | X | X | X | |
| 212 ESD | X | X | X | X | |
| 216 REMOTE ESD * | X | X | X | X | |
| 212 INTRUSION | X | X | X | X | |
| WELLHEAD PSLL | X | X | X | X | |
| WSSV/MSSV OPEN CLOSE STATUS (NOT SHOWN IN FIGS) | | | | | X |

CAUSE/EFFECT CHART FOR SOLAR-BATTERY POWERED WELL CONTROL PANEL

| CAUSE | EFFECT | | | | |
|---|---|---|---|---|---|
| | CLOSE DHV | CLOSE MSSV | CLOSE WSSV | ALARM | STATUS * |
| 220 FLOWLINE PSLL | X | X | X | X | |
| 220 FLOWLINE PSHH | | X | X | X | |
| R2 PSL HYDRAULIC | X | X | X | X | |
| 222 LAL TANK | | | | X | |
| C LSLL TANK | X | X | X | X | |
| 266 LOW BATT VDC | | | | X | |
| 212 FIRE | X | X | X | X | |
| 212 ESD | X | X | X | X | |
| 216 REMOTE ESD * | X | X | X | X | |
| 212 INTRUSION | X | X | X | X | |
| WELLHEAD PSLL | X | X | X | X | |
| WSSV/MSSV OPEN CLOSE STATUS (NOT SHOWN IN FIGS) | | | | | X |

FIG. 7

METHOD FOR WELLHEAD CONTROL

RELATED APPLICATION

This is a continuation-in-part of U.S. application Ser. No. 07/753,744 filed Sep. 3, 1991 naming the present inventor as applicant, now abandoned.

BACKGROUND OF THE INVENTION

1. Field Of The Invention

This invention is related to wellheads, to the control of wellheads and, in one aspect, to a solar powered wellhead control system for oil and gas wells.

2. Description Of Related Art

The prior art discloses a variety of controls for wellheads. Typically these apparatuses include one or more valves which are operable either on site or remotely in response to alarm conditions.

FIG. 1 depicts a typical prior art wellhead control system for controlling an hydraulically operated down hole valve or surface controlled subsurface safety valve ("SC-SSV"); a hydraulic/pneumatic master valve or hydraulic wireline cutter safety valve; and a hydraulic or pneumatic wing valve with quick exhaust device. Prior art systems such as this can be used for (1) single-point protection for flowlines, using direct-controlled surface safety valves ("SSV"); (2) multi-point protection for flowing wells and flowlines, using a pneumatic-controlled system with direct-controlled, tubing safety valves; and (3) a multiwell, multi-point protection system, using a combination of hydraulic and pneumatic systems to control both surface safety valves and surface controlled subsurface safety valves.

The equipment may be installed on a wellhead tree to protect against potentially hazardous conditions and from abnormal pressure situations in flowlines while providing complete shutdown capabilities. The pressure in each well's flowline is monitored by a specific monitor pilot which is located externally or internally in a control panel. The control panel monitors each well individually, and should flowline pressure exceed predetermined limits the monitor pilot is designed to block and bleed pneumatic control line pressure to close a safety valve on that particular well. Should an emergency occur, such as fire or damage to a wellhead, the control panel is designed to completely shut in the installation. In case of fire, the control panel reacts to loss of control pressure at the fusible plug. The control panel is designed to block and bleed both pneumatic and hydraulic pressure closing all of the safety valves.

Prior art control panels are designed to provide and control the hydraulic pressure required to hold open normally-closed surface and subsurface safety valves. Valves are designed to close with any loss of pressure in either the pilot or hydraulic lines to the valves. Control Panels are provided to control one well or multi-well installations, collectively or individually.

Prior art single-well control systems or panels enable the monitoring and protection of a specific well without affecting the status of surrounding wells. Such control panels are a complete unit containing a reservoir, pressure control regulators, relief valves, gauges and pumps with manual override. Being a complete unit, the control panel only requires connection to a power supply, to the safety valve, monitor pilot control line and to a gas or air supply line.

Prior art multi-well control panels are designed for safety systems which require control for more than a single producing well installation. These multi-well control panels use a module concept, either removable or integral. Each individual well control module contains components and display gauges essential for basic control of a specific well.

Several single wellhead control systems use pneumatic controls to monitor well flowing conditions, and emergency shutdown controls to close the wellhead valves. The source or media to operate the pneumatic controls is usually nitrogen, compressed air, or gas directly from the well itself. Each has disadvantages. Bottled nitrogen is costly, suffers from leaks, causes nuisance shut-ins, and results in loss of revenues. Compressed air requires electrical power and machinery. Natural gas does not provide the needed capacity in most case and the gas may be poisonous sour gas.

There has long been a need for a safe wellhead and wellhead control system that is operable by other than pneumatic power. There has long been a need for a wellhead control system that is solar powered. There has long been a need for such systems which can be used at remote sites. There has long been a need for such systems which can be placed adjacent or very near a wellhead while meeting the requirements of stringent electrical codes. There has long been a need for methods for the safe and efficient operation of wellheads and of their associated valves which methods do not rely on power provided from remote sources and which methods take into account responses to emergency conditions.

SUMMARY OF THE PRESENT INVENTION

The present invention discloses, in one aspect, a method for controlling a wellhead having a plurality of two or more valves, including a downhole valve in the well that controls flow of well fluid from the well to the surface and at least one surface valve that controls flow of the fluid in one or more flowlines from the wellhead to a location, usually a location remote from the wellhead, the method including producing power with an integral stand-alone self-contained power producer and delivering the produced power to a control unit and to pumping apparatus which supplies operating fluid to the valves, the control unit including in its functions the monitoring of a variety of conditions in and at the wellhead and well.

One embodiment of a basic method according to the present invention is a method for controlling a wellhead or "Christmas tree" and at least one downhole fluid-operated valve which controls the flow of fluid in a flowline from down within the well to the surface and at least one surface fluid-operated valve which controls the flow of fluid in a flowline or flowlines from the well to a location apart from the well, the method including: producing power from a power apparatus and delivering such power to a control unit and to a pumping device which pumps operating fluid to the valves, the control unit controlling the pumping device and operating the valves manually, as desired and/or automatically and/or in response to pre-set instructions included in the control unit. Other embodiments of the present invention include a basic method as described plus one, more, or all of the following aspects: the power apparatus is a solar power array and is adjacent or in very close proximity to the well head; providing power to a motor which in turn operates a pump which is part of the pumping device, and a motor which is controlled by the control unit; using a microprocessor and its related apparatuses, circuits, devices, switches etc. as the control unit; storing power produced by the solar power array in one or more battery apparatuses for use on demand in the methods, the use and flow of such stored power controlled and/or monitored by the control unit, preferably a microprocessor control unit; pumping operating fluid at one pressure, usually a relatively high pressure, to operate the downhole valve and pumping operating fluid at a lower pressure to the surface valve, manually, on demand, in response to a pre-set condition such as a monitored fluid flow parameter or monitored flowline condition, or in response to a monitored alarm, emergency condition, or intrusion by man or animal, and using either pneumatic or hydraulic operating fluid for either or both valves, or for all valves if more than two are present; controlling voltages of power from the solar array power apparatus with a voltage controller or controllers and, in one aspect, employing an alarm sensor or sensors in any or all of the power lines to provide an alert and/or an alarm signal and/or a shut-off signal if a pre-set voltage is exceeded or is not provided; sensing with a sensor(s) amount and pressure of available operating fluid either in any or all of the flow lines used and/or amount or pressure of fluid stored in a suitable storage vessel, either pneumatic or hydraulic, the sensor or sensors providing a signal or signals indicative of fluid volume and/or fluid pressure, and the control unit responding to such a signal by, as appropriate, operating one, some, or all of the valves and/or shutting down the well head and/or signalling other devices to increase fluid pressure and/or fluid amount [by operating flow device(s) permitting additional fluid to flow to one, some, or all of the flowlines or to the vessel or to increase fluid pressure]; the control unit operating valves sequentially as described herein; ventilating a housing or housings enclosing any or all of the apparatuses and/or devices used in any of the methods according to this invention; alarming the system when fire is detected to operate fire extinguishing apparatus automatically, to provide a fire alarm signal to a remote location, or to provide a fire alarm signal to the control unit to operate the valves to shut-in the well; providing signals of alarm or intrusion at the immediate area of the wellhead to remote location via known transmission methods and/or automatically shutting-in the well by operating the valves in response to one or more of such signals; operating the various components of the system(s) in a safe manner near or at the wellhead and employing intrinsically safe components wherever possible; controlling fluid flow to the valves by operating a solenoid which in turn controls each valve, the control unit controlling the solenoids; supplying power from the solar power array and/or from storage batteries to the control unit at 100 milliamperes or less; providing explosion-proof components and explosion-proof motor(s) for use with the method; employing at least three valves, two or more surface safety valves or SSV's, and a surface-controlled-subsurface safety valve or SC-SSV; controlling a well with an electric submersible pump or ESP or system therewith; remotely shutting-in the well by using switches interconnected therewith, telephone, radio, SCADA, DCS or satellite signals; locating equipment used with the method in a Class I Division 1 or 2 zone and/or without the need for using explosion-proof housings; extending a small bore hydraulic tubing from a nipple on an SC-SSV valve in a wellbore to the wellhead control or Christmas Tree at the surface and using a high pressure hydraulic signal to open or close the valve; supplying hydraulic fluid under pressure, up to 10,000 p.s.i. in one aspect, from a direct current explosion proof motor/pump combination (and/or a "PMDC" motor) to any or all of the valves, the control unit controlling such supply; using a system which is integral, stand alone, and self-contained and does not require other systems and/or power sources for operation; manually operating any or all of the system components; detecting dangerous gases in the well, in or at the wellhead, and in or at the flowlines and other components, and producing an alarm signal in response thereto; producing power for such a method with a thermoelectric generator instead of or in addition to a solar array power apparatus; using a motor or motors which utilize low power, preferably less than one horsepower; employing low power failsafe solenoid-operated valves, and sequentially operating first a downhole valve, then a master surface valve, then a wing surface valve. "Emergency conditions" include, but are not limited to: the presence of fire or dangerous gases; intrusion by unwanted humans or animals; vandalism, damage, or destruction of equipment used in the method; or too low to too high fluid pressures, fluid volumes, power amperages, or power voltages.

A wellhead control system according to one embodiment of this invention includes a solar array for collecting solar energy and converting it to electricity; a voltage controller for controlling the level of voltage, preferably between about 12 to about 30 VDC sent from the solar array; a battery bank of one or more batteries for storing electrical power from the solar array; a microprocessor control device powered by the battery bank, the microprocessor control interconnected via solenoid operated valves with one or more valves on the wellhead which can, when desired, shut-in the well; a motor driven by electricity from the battery bank and controlled by automatic pressure switch and a motor contactor; a pump driven by the motor and controlled by pressure switch and relay, the pump for pumping fluid, preferably hydraulic fluid, to the operate the valve or valves to open the well; and an hydraulic fluid supply reservoir for holding the hydraulic fluid which is pumped through the system.

In one preferred embodiment a nitrogen gas pressure accumulator is used so that expansion of the fluid due to, e.g. heat, does not damage the system and to protect the system from pump pulsations.

In one embodiment the microprocessor control is interconnected with a variety of safety switches (automatic and manual), solenoid valves, and sensors and controls their operation.

It is preferred that various electrical components of the system be weather proof and "intrinsically safe" (IS), i.e., that they require vastly reduced power levels and therefore minimize the risk of sparks and explosions, e.g. less than 100 milliamps. Such reduced power demands can also be met by power from the solar array and related battery bank.

A microprocessor based system according to this invention integrates a wide variety of functions and becomes the central processor or controller to control these functions. The microprocessor is a key element in the single wellhead control system. Recent strides in the microprocessor based industry has reduced the overall power requirement to operate such devices. Intrinsically safe units are now commercially available. Such units are also suitable for direct outdoor location.

The microprocessor in IS use will be used to monitor the well flowing conditions, fire detection, and ESD. Other applications include SCADA or Supervisory, Control and Data Acquisition systems for remote monitoring or control of wellheads via telecommunications links. The basic system is ESD, Fire and Wellhead High-Low pressure monitoring.

The microprocessor is preferably, a locally mounted weather-proof unit on a large weather-proofed enclosure mounted adjacent to the wellhead itself. The weather-proof enclosure also houses a direct current (DC) powered explosion proof motor and pump combination unit that provides the hydraulic power to open and close the wellhead safety valves. Included are the IS rated high pressure solenoid valves interfaced to the fire, ESD, and high-low controls indirectly via the microprocessor unit, and the hydraulic pump unit. The microprocessor will, preferably, be IS rated eliminating the need for bulky explosion proof style boxes. Most internal or external devices will be IS rated (not explosion proof). This simplifies the actual installation of all device. In certain preferred embodiments the electric motor, manual on/off switch, pressure switch and the motor contactor are explosion proof types.

To provide direct current power to power the motor and the microprocessor unit and its devices, a thermoelectric generator or a solar array, voltage controller, and battery bank are used which are mounted in the general locale of the wellhead control panel. The battery bank in one embodiment is sized for a minimum of 2 to 3 days autonomy. Batteries are preferably of gel types specifically for the application, but other types can be used. The solar array and batteries are, preferably, located at the single wellhead control panel, thus providing a simple compact system requiring only tubing connections to the wellhead valves and its flowline. With certain embodiments of the present invention, in the absence of electrical power or in the absence of fluid power (hydraulic system or pneumatic system), well shut down occurs, i.e. the system operates in a "fail-safe" mode.

Thus it is seen that a system according to this invention provides dual pressure capability; high pressure to a downhole valve and lower pressure for a surface valve using a hydraulic regulator; a remote capability for opening/closing by SCADA system; a sequenced opening and closing of valves; the capability to control-/operate an additional wing valve or pipeline valve; an intrusion/anti-theft capability; fail-safe modes; and optional pneumatic control pressure to surface valves and to other shut down devices.

It is, therefore, an object of the present invention to provide new, useful, unique, efficient, safe and effective wellhead devices and systems for controlling wellheads, and methods for controlling wellheads.

Another object of the present invention is the provision of such devices which are useful in extremely remote areas at which other forms of power are not available.

Yet another object of the present invention is the provision of such devices which employ solar power.

An additional object of the present invention is to provide such devices which have low power demands and are intrinsically safe.

Another object of the present invention is the provision of such devices which can control a variety of valves and safety apparatuses.

Yet another object of the present invention is the provision of such devices which may be powered pneumatically or hydraulically.

A further object of this invention is the provision of such devices with dual pressure capability. An additional object of this invention is the provision of such devices with an intrusion and anti-theft capability.

Another object of the present invention is the provision of such systems in which a microprocessor is used as a controller and the system has a "fail safe" mode for protecting a wellhead.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

FIG. 7 is a cause-effect chart for one embodiment of the present invention.

DESCRIPTION OF EMBODIMENTS PREFERRED AT THE TIME OF FILING FOR THIS PATENT

Figure 1:
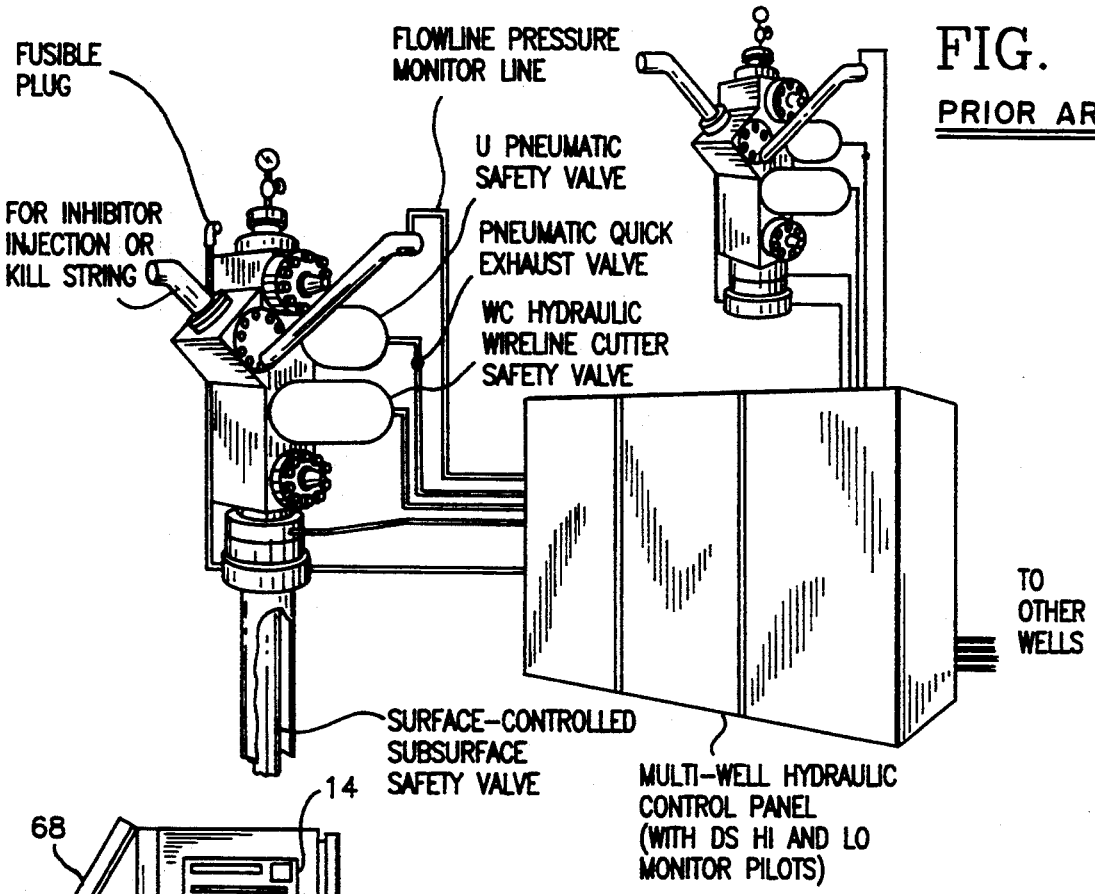
FIG. 1 PRIOR ART
FIG. 1 is a schematic view of a prior art wellhead control system.

A system 10 according to the present invention illustrated in FIGS. 3*a*, 3*b*, 4*a*, 4*b* has a housing 12 in which is mounted a microprocessor control 14, a motor 16, a pump 18, and a fluid supply tank 20 (preferably hydraulic fluid). A level gauge 37 such as a sight glass indicates the level of fluid in the tank 20. The tank 20 is filled through a filler 38 and has a flame arrestor 39. A power supply unit 22 for the microprocessor control 14 has cable inputs 24 for receiving a cable 26 from a battery bank 48. Hydraulic gauges 28 mounted through a front panel 30 of the housing 12 indicate pressure to the various valves and lines in fluid communication with the system 10. A stainless steel rack 36 supports the housing 12. It is preferred that the components of the system, to the extent possible, be made from 300 series stainless steel. It is also preferred that the microprocessor control 14 be weather-proof and intrinsically safe and that the power supply unit 22, the motor 16, and the motor control circuit be explosion proof. A shield 32 shields the front of the housing from sun and rain. A door 34 with a handle 32 is hingedly secured to the housing 12 for access to the housing's interior. A bulkhead 33 at the rear of the housing 12 provides a support for hydraulic interconnections (not shown) between the housing and wellhead valves.

The solar array 40 has a solar panel 42 mounted to a support 44. Cable 46 extends from the panel 42 through the support 44 to a voltage controller (not shown) and to a battery bank with batteries 48 in a battery box 50 mounted on a skid 52 to which the support 44 is also mounted. Holes 54 in the box 50 provide ventilation. An independent solar powered fan (not shown) can be mounted in or through the box 50 to provide air movement for ventilation.

Figure 2:
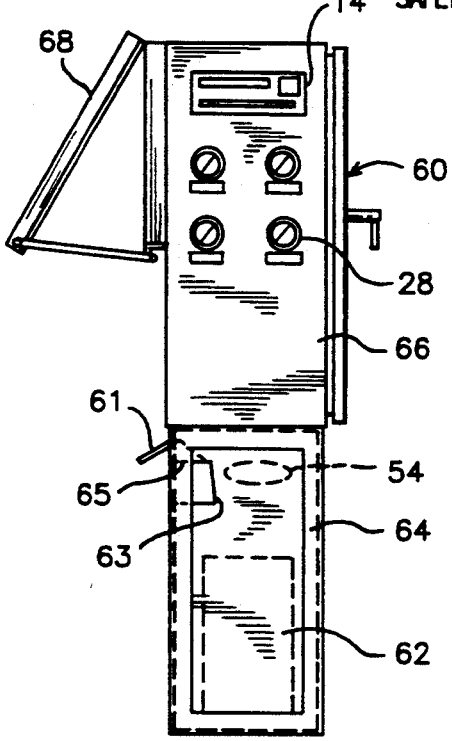
FIG. 2 is a front view of a system with a solar array and battery bank according to the present invention.
Figure 3A:
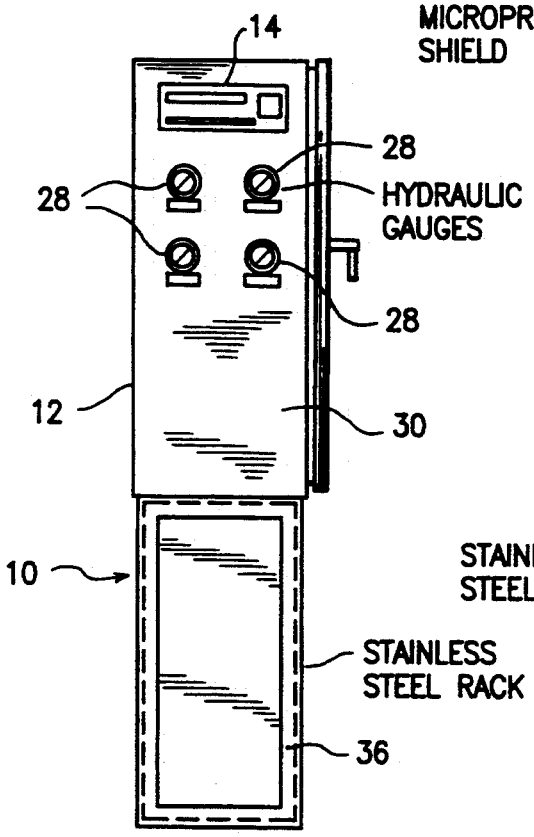
FIG. 3*a* is a front view of a system according to the present invention.
Figure 3B:
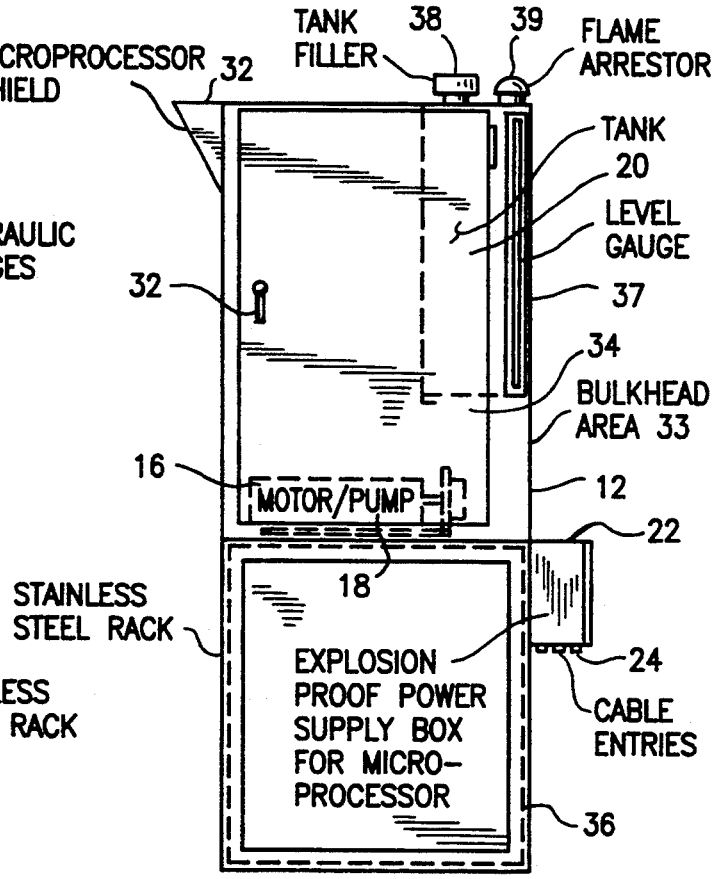
FIG. 3*b* is a side view of the system of FIG. 3*a*.
Figure 4A:
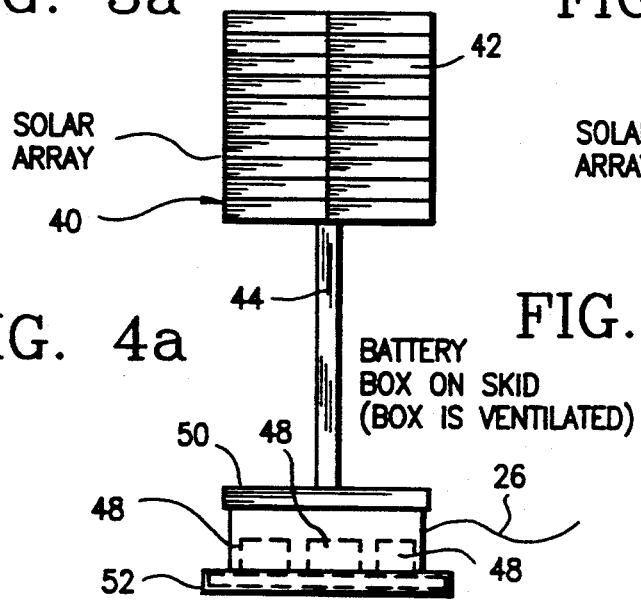
FIG. 4*a* is a front view of a separate solar array and battery bank system according to the present invention.
Figure 4B:
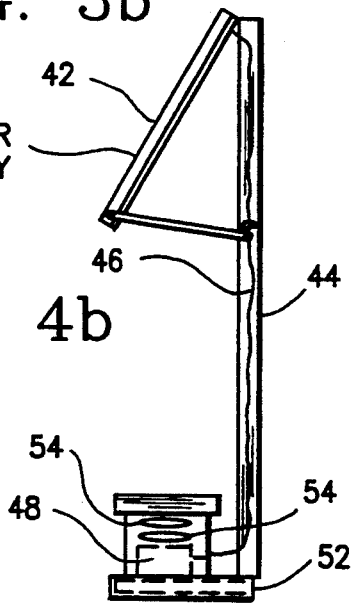
FIG. 4*b* is a side view of the system of FIG. 4*a*.

FIG. 2 illustrates another version of a system 60 according to this invention which is like the system 10 (FIG. 1) but in which batteries 62 are mounted in a battery box 64 in the lower part of the system that supports a housing 66 with a microprocessor control 14 and gauges 28. A solar array 68 is mounted to the housing 66 and a cable (non shown) extends from the solar array to a voltage controller (not shown) within the housing 66. A fan 63 mounted in an aperture 65 can ventilate the interior of the box 64. Preferably, a small solar array 61 mounted to the box 64 provides power for the fan 63. It is preferred that the embodiment of FIG. 2 meet Class I, Division 2 classified area requirements.

Figure 5:
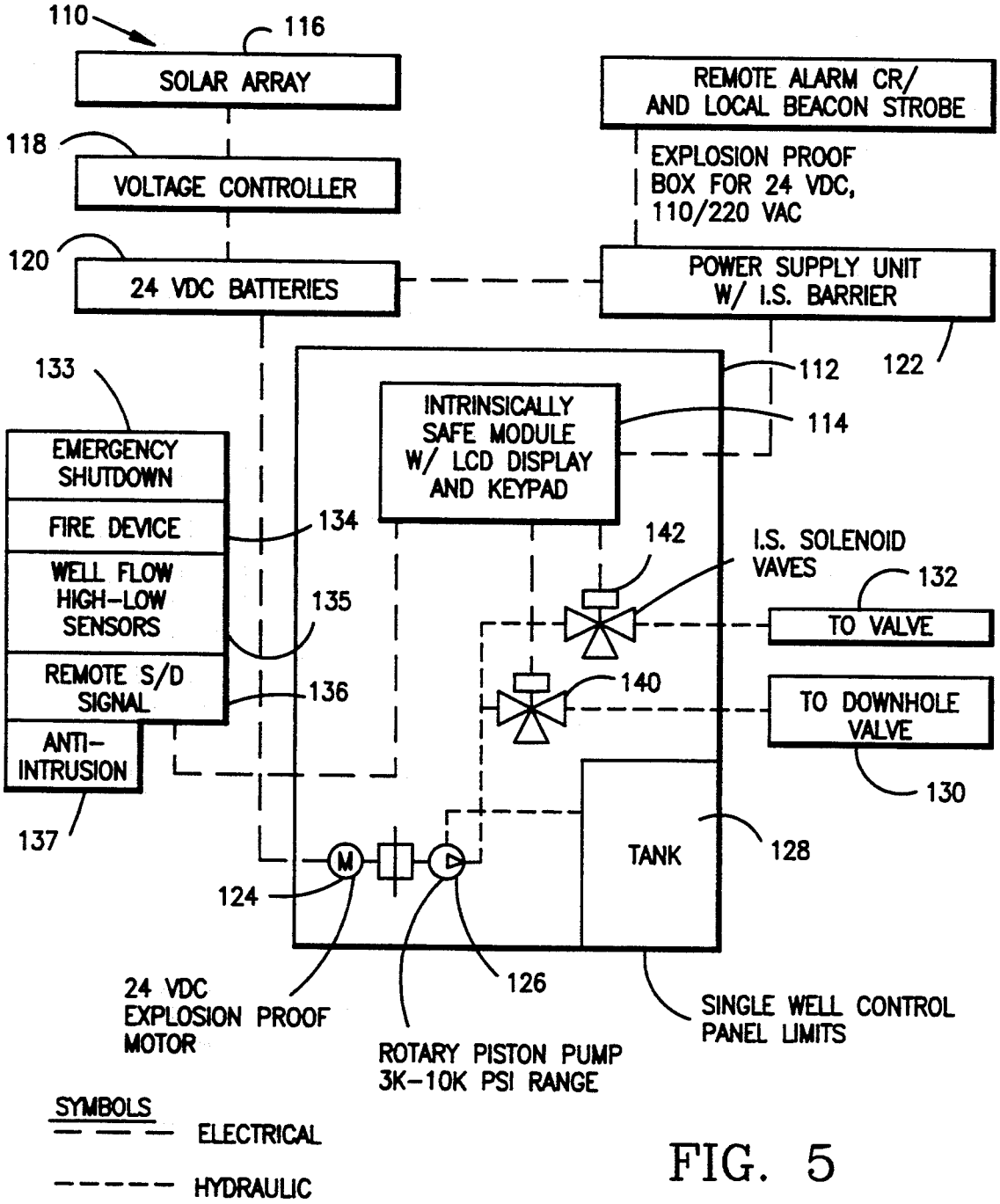
FIG. 5 is a schematic view of a system according to the present invention.

FIG. 5 presents schematically a system 110 according to the present invention which has a microprocessor unit 114 (preferably "intrinsically safe") which also preferably has an LCD display and a keypad. The microprocessor control unit 114 is mounted in a housing 112. Power is provided to the microprocessor unit 114 from a solar array 116. A voltage controller 118 delivers current at an appropriate voltage, e.g. 24 VDC nominal to one or more batteries 120, e.g. 12 volt direct current batteries wired for 24 VDC configuration. The batteries 120 provide 24 VDC nominal power to a power supply unit 122, preferably "intrinsically safe," which in turn supplies power to the microprocessor control unit 114. It is preferred that a box (not shown) for the batteries be made from non-ferrous metal and be adequately ventilated.

Alternatively, the power supply may provide a 110 volt alternating current or 220 volt alternating current if an alternate electrical power source is available (e.g. power line or generator). In one embodiment the motor and apparatus for controlling it operate independently of the microprocessor unit.

The batteries 120 also provide power to a motor 124 (preferably 24 VDC, explosion proof) via a motor contactor (not shown); which operates a pump 126, e.g. a rotary piston pump with a 3,000 to 10,000 p.s.i. range. The pump 126 pumps fluid, preferably hydraulic fluid, from a tank 128 to operate a wellhead with two valves, a downhole wellhead valve 130 and a surface wellhead valve 132. Both valves are controlled by solenoid valves 140 and 142, respectively, which in turn are controlled by the microprocessor control unit 114. The solenoid valves are preferably intrinsically safe.

The microprocessor unit 114 also provides intrinsically safe power to monitors and controls, a variety of safety switches with which it is interconnected including, e.g., an emergency shutdown switch 133 which is manually operable to give an alarm and shut-in a well to which the wellhead is connected; a fire device 134 which senses heat and gives an alarm and shuts-in the well when heat exceeds a certain temperature; well flow high-low pressure sensors 135 which monitor pressure in a flow line from the well give an alarm and shut it in when a set pressure is exceeded (high) or when pressure falls below a predetermined set level (low); remote shut down signal 136 which can be remotely operated via automatic/manual means via telecommunications to give an alarm and shut-in the well, e.g. by telephone, radio or satellite transmission; and an anti-intrusion sensor (e.g. light beam, trip wire, sound vibration) 137 which when activated automatically gives an alarm and shuts-in a well, e.g. when theft is attempted or a bulldozer accidentally cuts a flow line.

Figure 6:
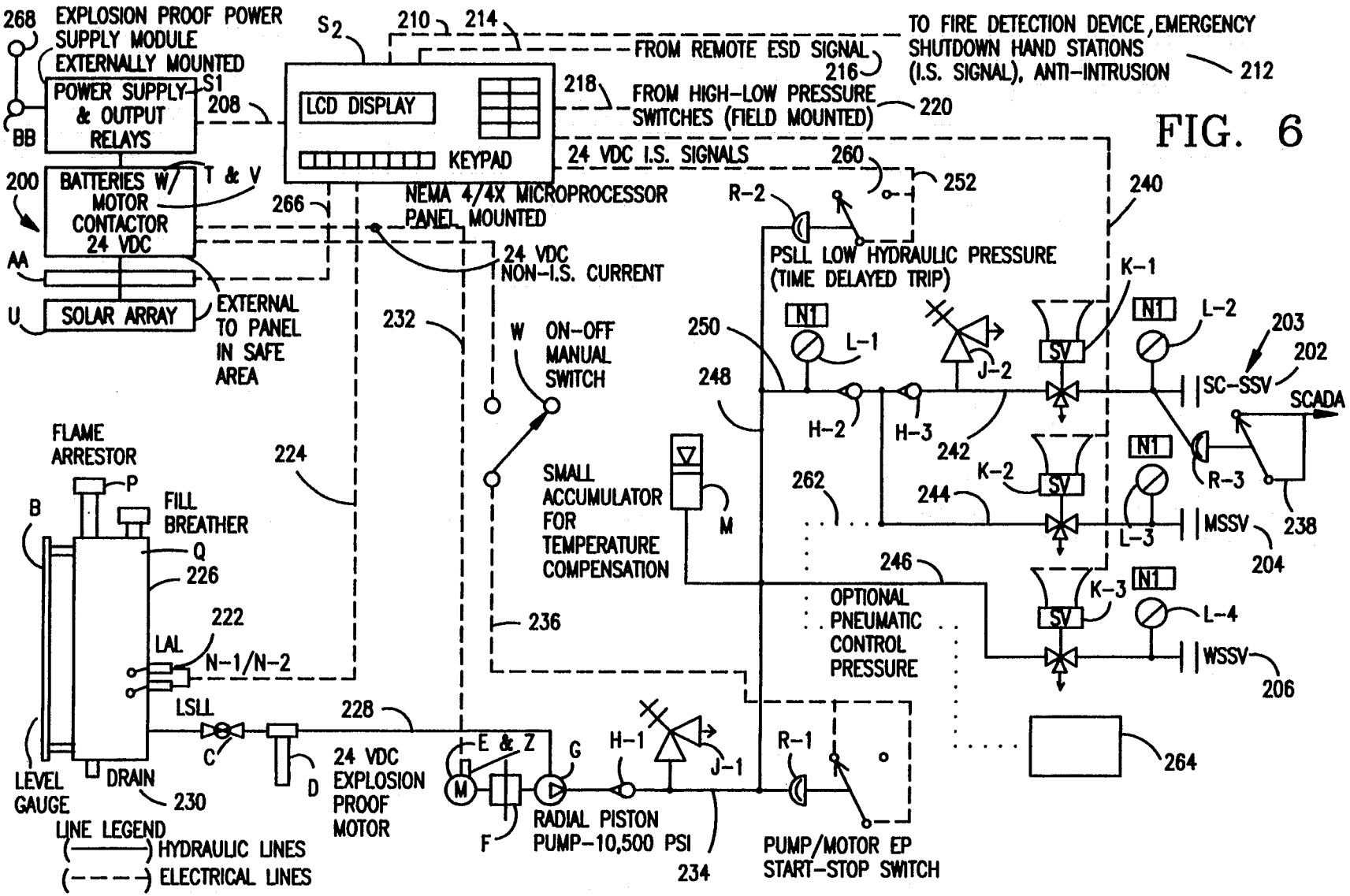
FIG. 6 is a schematic view of a system according to the present invention.

FIG. 6 illustrates a wellhead control system 200 according to the present invention which is like the system shown in FIG. 5 but which is shown as including a wellhead 203 with three wellhead valves, a downhole valve 202, a master surface valve 204, and a wing surface valve 206. The master and wing surface valves can be hydraulic or pneumatic control valves.

Electrical power flows from a solar array U to a voltage controller AA, and then to batteries T which store power from the solar array U and provide power to a power supply $S_1$. It is preferred that a motor relay/-contactor V be employed through which flows the load, e.g. 30 or more amps, to a motor E.

The power supply $S_1$ provide power to a microprocessor control unit $S_2$ via a line 208. The voltage controller AA is interconnected with the microprocessor unit $S_2$ via an alarm line 266 so that an alarm is given if the voltage exceeds a predetermined level. Via a line 210 the microprocessor control unit $S_2$ interfaces with safety devices 212 (like the devices 133–137, FIG. 5). Via a line 214, the unit $S_2$ interfaces with a remote shut down signal 216, (e.g. one with electrical relay contacts, or dry contacts) via programmable logic controller system or from a SCADA system or remote terminal unit ("RTU") connected to a SCADA system. Via a line 218 the unit $S_2$ interfaces with high-low pressure switches 220.

A level alarm sensor 222 is interconnected with the microprocessor control unit $S_2$ via a line 224. If a level of hydraulic fluid in a supply tank 226 falls below the alarm level, a switch in the level sensor 222 is tripped open and a signal is sent to the unit $S_2$. In response the unit $S_2$ will activate an alarm 268 for a remote alarm and/or a local alarm, e.g. a beacon BB from output relays in the power supply S. A valve C is an isolation valve to make it possible to service a filter D in the line 228 which filters fluid flowing to a pump G. Fluid can be drained from the tank 226 through a drain 230. A level gauge B indicates the fluid level in the tank 226 and the tank is filled through a filler/breather Q. A flame arrestor P will arrest flame from within the tank 226 in the event of fire therein.

The batteries T supply power to the motor E via a line 232. A junction box Z provides terminals for the motor connection and a motor-pump coupling F provides motor-to-pump connection.

The pump G pumps fluid from the tank 226 into a line 234 which leads to lines interconnected with the wellhead valves 202, 204, 206 to operate the valves. A relief valve J-1 provides overpressure protection and a one-way check valve H-1 prevents backflow. Once the check valve H-1 closes, pressure is relieved through the relief valve J-1 thus protecting downstream components.

The batteries T through the motor contactor V provide power via line 236 to a motor start-stop pressure switch R-1. Power flow through the line 236 is controlled by a manual on/off switch W. Pressure switch R-1 activates the switch to start the motor E when pressure in the line 234 falls below a desired level and stops the motor E when pressure in line 234 reaches a predetermined cut off pressure.

An accumulator M receives expanded hydraulic fluid when the pressure in the system builds up, e.g. due to external heating, and also acts as a damper for fluid pulses.

The microprocessor control unit $S_2$ provides power via multiple lines 240 (one shown) to solenoid valves K-1, K-2, and K-3 which in turn sequentially open lines 242, 244, and 246 respectively in sequence by, e.g., manually operating a keypad on the microprocessor control unit $S_2$. In one embodiment in which such manual operation is mandatory, there is an added safety feature—i.e., this insures personnel are present to operate the wellhead valves. Gauges L-2, L-3, and L-4 indicate the pressure level in these lines and whether the lines are open to the valves.

Fluid flows from the line 234 to the line 248 and then into the line 250. At this point, due to the check valves H-2 and H-3, the fluid can be diverted to any one of the three valves 202, 204, and 206. This permits sequential opening of these valves without affecting the hydraulic pressure drop in other valves. For example, with appropriate settings for the valves H-2 and H-3, and with the solenoid valves K-2 and K-3 holding lines 244 and 246 closed, fluid flows through the line 242 to the valve 202, after the solenoid valve K-1 is activated, opening the line 242 to valve 202. Gauge L-2 reads the pressure. By activating solenoid valve K-2, fluid is permitted to flow in line 244 and operate the valve 204. After the valve 204 is opened, the solenoid valve K-3 is activated, opening the line 246 to the valve 206. The check valve H-2 maintains the valve 204 open while the pump G opens the valve 206 via the lines 234 and 246. The gauge L-4 read the pressure.

The preferred closing sequence is the opposite, closing the valve 206 first, valve 204 second, and valve 202 last because it is prudent, due to the relatively high pressure across the valve 206, to close it first. The valves 202 and 204 close sequentially and in a balanced condition as flow is stopped via the valve 206. This reduces wear and tear on the valves 202 and 204.

A gauge L-1 indicates the pressure level in the line 250. A relief valve J-2 relieves thermal pressure once the check valves H-2 and H-3 are closed. A low pressure switch 260 in a line 252 that communicates with the line 248 senses the pressure level in the line and is activated if the pressure decays below a certain level. The unit $S_2$, receiving a signal from the switch 260 via line 252 will then shut-in the well by closing the valve 206 first, followed by the valve 204. After a brief time delay; then, followed by the valve 202 after a brief time delay, solenoid valves K-1, K-2 and K-3 are deactiviated. The down hole valve 202 can be remotely monitored, e.g. via SCADA, and a pressure switch 238.

It is preferred that various items shown in FIG. 6 have the following specifications:

| ITEM | DESCRIPTION | SERVICE |
|---|---|---|
| A | STAINLESS STEEL NEMA 4/4× ENCLOSURE w/INTEGRAL TANK RACK MOUNTED | GENERAL |
| B | LEVEL GAUGE, ¼" LOW PRESSURE TYPE | HYDRAULIC |
| C | LOW PRESSURE BALL VALVE ½" SIZE | HYDRAULIC |
| D | LOW PRESSURE FILTER ½" PORT, 20 MICRON FILTER, STD. OR SST | HYDRAULIC |
| E | 24 VDC EXPLOSION PROOF MOTOR, .75 TO 1 HP RANGE, 1600–1800 RPM LOW POWER CONSUMPTION | ELECTRIC |
| F | MOTOR-PUMP COUPLING | GENERAL |
| G | RADIAL PISTON PUMP, 10,500 PSI MAX DISCHARGE, MINI VERSION | HYDRAULIC |
| H-1,2,3 | CHECK VALVE, ¼" NPT, SST, 10,000 PSI, POPPET TYPE | HYDRAULIC |
| J-1,2 | RELIEF VALVE, ¼" NPT, SST, 10,000 PSI, MINI VERSION | HYDRAULIC |
| K-1,2,3,4 | 24 VDC I.S. SOLENOID VALVE, SST 10,000 PSI, ¼" PORT, MANUAL OVERRIDE | ELECTRO-HYDRAULIC |
| L-1,2,3,4 | PRESSURE GAUGE, 2½" DIAL SIZE 0-15,000 PSI RANGE, SST CASE/ SOCKET/BOURDON TUBE, PANEL MOUNT | HYDRAULIC |
| M | PISTON ACCUMULATOR, OIL or WATER SERVICE, APPROX. 1 GALLON CAPACITY, 10,000 PSI, non ASME or ASME TYPES, VITON SEALS | HYDRAULIC |
| N-1, N-2 | LEVEL SWITCH, STANDARD SERVICE, SPDT CONTACTS, GOLD PLATED, SST FLOAT FOR 0.86 SPECIFIC GRAVITY | HYDRAULIC |
| P | FLAME ARRESTOR, 1" NPT, SST | GENERAL |
| Q | TANK FILLER/BREATHER/STRAINER, | GENERAL |

-continued

| ITEM | DESCRIPTION | SERVICE |
|---|---|---|
| | SST | |
| R1,2,3 | PRESSURE SWITCH, STD. SERVICE, 10,000 PSI RANGE, ADJUSTABLE, GOLD PLATED SPDT CONTACTS (R-1 IS EP TYPE, NOT GOLD PLATED) | ELECTRIC |
| $S_1$, $S_2$ | MICROPROCESSOR w/EXPLOSION PROOF POWER SUPPLY FOR 24 VDC SERVICE, COMPLETE w/I.S. BARRIER (e.g. FLEXGUARD BY AMOT CONTROLS or EQUAL) | ELECTRIC |
| T | GEL CELL SEALED BATTERIES FOR PHOTOVOLTIC SRVICE, 90 AMP-HRS RATED, 12 VDC | ELECTRIC |
| U | SOLAR ARRAY FOR 24 VDC SERVICE, APPROX 53 WATTS UNITS (by SIEMENS SOLAR OR EQUAL) | ELECTRIC |
| V | 24 VDC ONTACTOR, 30 AMP LOAD RATING, SPST CONTACT | ELECTRIC |
| W | TWO POSITION ON-OFF SWITCH, SPST CONTACT, EP TYPE, PANEL MOUNTED | ELECTRIC |
| X | 316 STAINLESS STEEL TUBING, SEAMLESS OR WELDED TYPE, PER ASTM A-269 or SA-213 (OPTIONAL: MONEL 4000 OR INCOLOY 825) | HYDRAULIC |
| Y | 316 STAINLESS STEEL FITTINGS, DUAL FERRULE TYPE FOR HIGH PRESS, NPT CONNECTIONS | HYDRAULIC |
| Z | JUNCTION BOX w/TERMINALS FOR MOTOR CONNECTION, EXPLOSION PROOF, SIZE TO SUIT, c/w SEAL PER NATIONAL ELECTRIC CODES RULES FOR CLASS 1, DIVISION 1, GRPS. C & D, & RIGID CONDUIT | ELECTRIC |
| AA | VOLTAGE CONTROLLER ELECTRIC W/LOW VOLTAGE SENSOR TRIP | ELECTRIC |
| BB | BEACON STROBE, 24 VDC, LOW POWER STROBE TYPE, CLASS I, DIVISION 1 | ELECTRIC |

FIG. 7 is a cause-effect chart which shows what the system will do when a switch or alarm (see FIG. 6) in the "cause" column is activated. For example, if the fire switch 212 is activated, the DHV valve 202, the MSSV valve 204, and the WSSV valve 206 will all be activated, the well will thus be shut-in, and an alarm will sound.

The unit $S_2$ controls the flowline PSLL sensor 260 so that it is by-passed during wellhead start-up (with zero p.s.i. hydraulic pressure the sensor is tripped and reset is not possible).

Although it is preferred to use hydraulic fluid to operate wellhead valves, it is possible according to this invention to employ pneumatic power to operate valves. In the embodiment 200 an optional pneumatic line 262 is in fluid communication with the surface valves 204, 206 and a pneumatic power source 264 is provided by other means (compressor or gas from the wellhead). Low pressure pneumatic control type intrinsically safe solenoid operated valves are used instead of the higher pressure solenoid valves used in an hydraulic system.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A method for controlling a wellhead on a well, the well extending from beneath the earth to a surface thereof, the wellhead including a plurality of valves for controlling flow of fluids in flowlines to and from the well, each fluid having a pressure level in a flowline, the plurality of valves including at least a downhole valve and a surface valve, the downhole valve controlling flow of fluid from within the well to the surface and the surface valve controlling flow of fluid from the well to a location, the method comprising the step of:

producing power from an integral stand-alone power apparatus for producing electric power adjacent the well;

delivering power produced by the power apparatus to a control unit and to pumping apparatus;

operating the pumping apparatus to pump operating fluid to the downhole valve to operate the downhole valve and pumping operating fluid to the surface valve to operate the surface valve; and controlling the pumping and the valves with the control unit.

2. The method of claim 1 wherein the downhole valve is disposed in a well flowline, and the surface valve is disposed in a surface flowline; and the method further comprising the steps of:

monitoring pressure of fluids and the flowlines and sensing a pressure level in each flowline;

producing an alarm signal if pressure is not within a pre-set acceptable range and transmitting an alarm signal to the control unit; and shutting-in the well in response to the alarm signal by operating the downhole valve and the surface valve to close off their respective flowlines to fluid flow.

3. The method of claim 2 wherein the downhole valve is operated first and then the surface valve is operated.

4. The method of claim 3 wherein pressure of operating fluid operating the surface valve is less than pressure of operating fluid operating the downhole valve.

5. The method of claim 4 wherein the surface flowline also has a wing valve therein in addition to the surface valve, the wing valve for closing off flow therein, and the method further comprising the step of:

operating the wing valve prior to operating the surface valve.

6. The method of claim 1 wherein the operating fluid is an hydraulic fluid.

7. The method of claim 5 wherein the wing valve and the surface valve are solenoid operated valves operated by solenoids; and the method further comprising the step of:

controlling the solenoids and operating them with the control unit.

8. The method of claim 1 wherein the control unit and power apparatus are within a housing, the housing having interior space within which are the control unit and power apparatus, the method including:

ventilating the housing.

9. The method of claim 8 wherein the control unit is a microprocessor control unit.

10. The method of claim 1 wherein the power apparatus is a solar power array and the method includes:

storing power produced by the solar power array in at least one storage battery, the control unit interconnected with the at least one storage battery for controlling delivery of power to the valves and to the pumping apparatus.

11. The method of claim 10 wherein the pumping apparatus includes a motor and a pump, the motor connected to the pump for operating the pump, the method including:

controlling operating of the motor with the control unit.

12. The method of claim 11 including: controlling voltage of the electric power with a voltage controller.

13. The method of claim 11 wherein the power apparatus produces electrical power at a voltage and at an amperage and the method includes:

sensing the voltage of the electrical power and the amperage of the electrical power;

producing signals indicative of sensed voltage and sensed amperage;

transmitting the signals to the control unit;

analyzing the signals and determining whether the voltage and amperage are within an acceptable range;

producing an alarm signal if voltage or amperage is not within the acceptable range; and shutting-in the well in response to the alarm signal.

14. The method of claim 1 including:

delivering power to the control unit at an amperage less than 100 milliamps.

15. The method of claim 1 including:

sensing at the wellhead an emergency condition;

producing an emergency signal in response to the emergency condition;

transmitting the emergency signal to a location remote from the wellhead; and receiving the emergency signal at the remote location and, in response thereto, sending an actuation signal from the remote location to the control unit to operate the valves to shut-in the well.

16. A method for controlling a wellhead on a well, the well extending from beneath the earth to a surface thereof, the wellhead including a plurality of valves for controlling flow of fluids in flowlines to and from the well, the plurality of valves including at least a downhole valve and a surface valve, the downhole valve disposed in a downhole flowline from within the well to the surface and controlling flow of fluid therein and the surface valve disposed in a surface flowline from the well to a location and the surface valve controlling the flow of fluid therein, the method comprising the steps of:

producing power from an integral stand-alone solar power array power apparatus for producing electric power adjacent the well;

delivering power produced by the power apparatus to a control unit and to pumping apparatus;

operating the pumping apparatus to pump operating fluid to the downhole valve to operate the downhole valve and pumping operating fluid to the surface valve to operate the surface valve;

controlling the pumping apparatus and the valves with the control unit;

monitoring pressure of fluid in the flowlines and sensing a pressure level therein;

producing a pressure alarm signal if pressure is not within a preset acceptable range and transmitting the pressure alarm signal to the control unit;

shutting-in the well in response to the pressure alarm signal by operating the downhole valve and the surface valve to close off their respective flowlines to fluid flow;

storing power produced by the solar power array in at least one storage battery, the control unit interconnected with the at least one storage battery for controlling delivery of power to the valves and to the pumping apparatus;

sensing voltage of the electrical power and amperage of the electrical power;

producing power signals indicative of sensed voltage and sensed amperage;

transmitting the power signals to the control unit;

producing a power alarm signal if voltage or amperage is not within an acceptable range;

shutting-in the well in response to the power alarm signal;

monitoring at the wellhead for an emergency condition;

producing an emergency signal if an emergency condition is monitored; and shutting-in the well in response to the emergency signal.

* * * * *